US006664014B1

(12) United States Patent
Kikuchi et al.

(10) Patent No.: US 6,664,014 B1
(45) **Date of Patent: *Dec. 16, 2003**

(54) ELECTROPHOTOGRAPHIC PHOTOSENSITIVE MEMBER ELECTROPHOTOGRAPHIC APPARATUS USING SAME AND DEVICE UNIT USING SAME

(75) Inventors: Toshihiro Kikuchi, Yokohama (JP); Akio Maruyama, Tokyo (JP); Kazushige Nakamura, Yokohama (JP); Michiyo Sekiya, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/852,037

(22) Filed: May 6, 1997

Related U.S. Application Data

(63) Continuation of application No. 08/580,490, filed on Dec. 29, 1995, now abandoned, which is a continuation of application No. 08/174,705, filed on Dec. 29, 1993, now abandoned.

(30) Foreign Application Priority Data

Jan. 6, 1993 (JP) ..... 5-000755
Jan. 6, 1993 (JP) ..... 5-000811
Jan. 6, 1993 (JP) ..... 5-000823

(51) Int. Cl.[7] ..... G03G 5/147
(52) U.S. Cl. ..... 430/66; 430/132
(58) Field of Search ..... 430/66, 132, 100, 430/67

(56) References Cited

U.S. PATENT DOCUMENTS

| | | | | | |
|---|---|---|---|---|---|
| 3,901,700 | A | * | 8/1975 | Yoerger et al. | 430/66 |
| 4,148,637 | A | * | 4/1979 | Kubota et al. | 430/66 |
| 4,409,309 | A | | 10/1983 | Oka | 430/65 |
| 4,426,435 | A | * | 1/1984 | Oka | 430/66 |
| 5,008,172 | A | | 4/1991 | Rokutanzono et al. | 430/67 |
| 5,246,805 | A | | 9/1993 | Miyasaki et al. | 430/57 |
| 5,252,251 | A | | 10/1993 | Sato et al. | 252/299.01 |
| 5,391,449 | A | * | 2/1995 | Maruyama et al. | 430/66 |
| 5,963,762 | A | * | 10/1999 | Furuya et al. | 399/174 |

FOREIGN PATENT DOCUMENTS

| | | | | |
|---|---|---|---|---|
| EP | 057532 | | 8/1982 | G03G/5/14 |
| EP | 510644 | | 10/1992 | G03G/5/06 |
| JP | 57-30846 | | 2/1982 | G03G/5/14 |
| JP | 62-295066 | | 12/1987 | G03G/5/14 |
| JP | 2-50167 | | 2/1990 | G03G/5/147 |
| JP | 2-236558 | * | 9/1990 | |
| JP | 3-171060 | * | 7/1991 | 430/66 |
| JP | 4-328570 | | 11/1992 | |
| JP | 5-181299 | * | 7/1993 | 430/66 |

OTHER PUBLICATIONS

English Abstract of JP 4–328570 (Nov. 1992).*
Derwent Acc. No. 1990–330732, 1990.*
Derwent Acc. No. 1985–187284, 1985.*
Diamond, Arthur S. (editor) Handbook of Imaging Materials. New York: Marcel–Dekker, Inc., 1991.*
W. Cheng, "Poor Insulating Coating for use in an Electrophotographic Process", IBM Tech. Discl. Bull., vol. 19, No. 1, pp. 287, 1976).
Patent Abstracts, Japan, vol. 18, No. 17, (P–813) Jan. 17, 1989.
Patent Abstracts, Japan, vol. 12, No. 331 (P–755) (3178) Sep. 1988.
Patent Abstracts, Japan, vol. 17, No. 600 (P–1637) Nov. 4, 1993.
Patent Abstracts, Japan, vol. 7, No. 54, (P–180) Mar. 4, 1983.
Patent Abstracts, Japan, vol. 14, No. 385 (P–094) (4328) Aug. 1990.

* cited by examiner

*Primary Examiner*—Christopher Rodee
(74) *Attorney, Agent, or Firm*—Fitzpatrick, Cella, Harper & Scinto

(57) ABSTRACT

An electrophotographic photosensitive member is constituted by disposing a protective layer and a photosensitive layer on an electroconductive support in this order. The protective layer is characterized by containing an electroconductive particles, fluorine-containing resin particles and a binder resin. The photosensitive layer is suitable for providing an electrophotographic apparatus showing excellent electrophotographic characteristics such as a high photosensitivity and a low residual potential and also providing good image forming properties under any environmental condition, improved pause memory characteristics and a decreased transfer memory.

9 Claims, 1 Drawing Sheet

ELECTROPHOTOGRAPHIC PHOTOSENSITIVE MEMBER ELECTROPHOTOGRAPHIC APPARATUS USING SAME AND DEVICE UNIT USING SAME

This application is a continuation, of application Ser. No. 08/580,490 filed Dec. 29. 1995, now abandoned; which is a continuation of application Ser. No. 08/174,705, filed Dec. 29, 1993, now abandoned.

FIELD OF THE INVENTION AND RELATED ART

The present invention relates to an electrophotographic photosensitive member (hereinafter, simply referred to as "photosensitive member"), particularly to a photosensitive member having a specific protective layer.

The present invention also relates to an electrophotographic apparatus and a device unit respectively using the photosensitive member.

Heretofore, there have been known photosensitive members to be applied to an electrophotographic process generally including the steps of: charging-exposure-development-transfer-cleaning-charge erasure. More specifically, an electrostatic latent image formed through the steps of charging and exposure is visualized into a toner image by developing fine particles called "toner" in the step of development. The toner image was transferred to a transfer-receiving material such as paper by transfer means. At this time, all the toner particles are not transferred and a part of the toner particles remains at the surface of the photosensitive member.

If a large amount of such residual toner particles remains at the surface of a photosensitive member, a resultant image to be formed on a transfer-receiving material has considerable decreased toner particles in a mottled or spotted form, thus failing to provide uniformity of the image. Moreover, the photosensitive member encounters a problem of toner sticking to the surface of the photosensitive member or occurrence of filming phenomenon.

In order to solve the problems, the photosensitive member is required to have an improved releasability at the surface thereof.

The photosensitive member is also required to exhibit a durability against external forces such as an electrical force and a mechanical force because the external forces are directly imposed on the photosensitive member in the above-mentioned electrophotographic process. More specifically, the photosensitive member is required to have resistances to abrasion and mar due to friction and a resistance to deterioration on a surface layer due to adhesion of active substances, such as ozone and NOx, generated at the time of charging.

In order to satisfy the above characteristics, various protective layers for a photosensitive member, particularly those comprising a resin as a main component, have been studied and proposed. Among them, many protective layers formed by adding metal or metal oxide to a resin to control an electrical resistance of the protective layer have been proposed. However, a photosensitive member using such a protective layer has encountered a problem of considerable decrease in photosensitivity because absorption of light in the protective layer is caused to occur and an amount of light arriving at the photosensitive layer is decreased.

Accordingly, there has been proposed a method of preventing a decrease in photosensitivity by dispersing metal oxide having an average particle size of at most 0.3 $\mu$m as electroconductive particles within a protective layer to improve a transparency to visible light as disclosed in, e.g., Japanese Laid-Open Patent Application (JP-A) No. 30846/1982.

Such a dispersion of metal oxide in a protective layer for a photosensitive member generally is performed in order to control an electrical resistance of the protective layer alone to suppress an increase in a residual potential within the photosensitive member. It has been known that a protective layer for a photosensitive member may suitably have an electrical resistivity in a range of $10^{10}$–$10^{15}$ ohm.cm. However, in the above resistivity range, an electrical resistance of the protective layer is liable to vary depending upon a degree of ion conduction, thus largely changing a value of the electrical resistance depending upon environmental conditions such as temperature and humidity. Particularly, when metal oxide particles have been dispersed in a protective layer, it has been heretofore difficult to keep a resistivity of the protective layer being within the above resistivity range during a repetitive electrophotographic process under various environmental conditions because the metal oxide particles generally have large water absorption properties at the surface thereof. Further, under a high humidity condition, active substances such as ozone and NOx generated by repeatedly charging attach to the surface of a photosensitive member to cause decreases in a resistivity at the surface of the photosensitive member and a releasability of toner particles, thus resulting in occurrence of image flow and an insufficient uniformity of an image.

In order to remedy the above drawbacks, there have been proposed various protective layers including: one containing an additive such as fluorine-containing silane coupling agent, titanate coupling agent or $C_7F_{15}NCO$ as disclosed in JP-A 306857/1989; one containing metal or metal oxide fine particles having improved dispersibility and resistance to humidity by effecting water-repellent treatment to the fine particles together with a binder resin as disclosed in JP-A 295066/1987; and one containing metal oxide fine particles surface-treated with an agent, such as titanate coupling agent, fluorine-containing silane coupling agent or acetoalkoxyaluminum diisopropylate, together with a binder resin as disclosed in JP-A 50167/1990 corresponding to U.S. Pat. No. 5,008,172.

These protective layers, however, are still insufficient in releasability of a binder resin per se used for a protective layer, resistances to abrasion and mar due to friction and a resistance to active substances such as ozone and NOx, thus failing to satisfy electrophotographic characteristics meeting a recent requirement of improved image quality.

With recent requirements of improved durability and high image quality, a photosensitive member has encountered a new problem of "pause memory characteristic", a deterioration phenomena. More specifically, pause memory characteristic means a phenomenon that a chargeability at a part of a photosensitive member immediately under a corona charger is decreased when the rotation of the photosensitive member is stopped during repetitive copying, whereby the part of a photosensitive member has a decreased image density in a normal development system and has an increased image density in a reversal development system. Such a phenomenon (i.e., pause memory characteristic) is liable to occur after repetitive use for a long term, thus being a more serious problem with an elongated life of a photosensitive member.

Moreover, in a reversal development system in a recent digital copying system, a so-called "transfer memory" by which a chargeability is changed depending upon the presence or absence of transfer current because primary charging and transfer charging are performed by using polarities opposite to each other is caused to occur, thus resulting in an unevenness in image density.

SUMMARY OF THE INVENTION

The present invention has been accomplished in order to meet the above requirements.

An object of the present invention is to provide an electrophotographic photosensitive member having a surface with advantages including a high releasability and excellent resistance to abrasion and mar and also capable of maintaining high image quality.

Another object of the present invention is to provide a photosensitive member free from a decrease in a surface resistance (resistivity) due to adhesion of active substances generated by repetitive use and capable of retaining high image quality even under a high humidity condition.

Another object of the present invention is to provide a photosensitive member showing stable electrophotographic characteristics wherein accumulation of residual potential and a decrease in photosensitivity are not readily caused to occur even when used repetitively.

Another object of the present invention is to provide a photosensitive member having a decreased transfer memory even in a reversal development system.

Another object of the present invention is to provide an electrophotographic photosensitive member having an improved pause memory characteristic.

Another object of the present invention is to respectively provide an electrophotographic apparatus and a device unit including the electrophotographic photosensitive member.

According to the present invention, there is provided an electrophotographic photosensitive member, comprising: an electroconductive support, and a photosensitive layer and a protective layer disposed on the electroconductive support in this order, wherein said protective layer comprises electroconductive particles, fluorine-containing resin particles and a binder resin.

According to the present invention, there is also provided an electrophotographic apparatus and a device unit including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
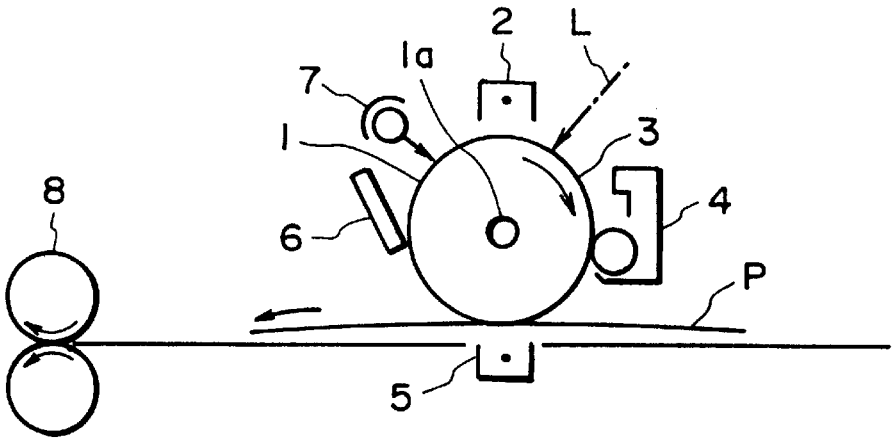
FIG. 1 is a schematic structural view of an electrophotographic apparatus using an electrophotographic photosensitive member according to the present invention.

The electrophotographic photosensitive member according to the present invention is characterized by a protective layer comprising electroconductive particles, fluorine-containing resin particles and a binder resin.

The electroconductive particles used in the present invention may include those comprising metal, metal oxide and carbon black. Examples of metal may include: aluminum, zinc, copper, chromium, nickel, stainless steel, silver, etc.; and plastic particles the surface of which is covered with vapor-deposition of these metals. Examples of metal oxide may include: zinc oxide, titanium oxide, tin oxide, antimony oxide, indium oxide, bismuth oxide, indium oxide doped with tin, tin oxide doped with antimony, and zirconium oxide doped with antimony. These materials may be used singly or in combination of two or more species. When two or more species of these materials are used, they may be simply mixed or be formed into a solid solution or a fused mixture.

The electroconductive particles used in the present invention may preferably have an average particle size of at most 0.3 $\mu$m, more preferably at most 0.1 $\mu$m, in view of prevention of a decrease in photosensitivity.

In the above materials for the electroconductive particles, metal oxide as described above may particularly be preferred in view of transparency etc.

The fluorine-containing resin particles used in the present invention may include those comprising polymers, such as, tetrafluoroethylene resin, chlorotrifluoroethylene resin, hexafluorinated ethylene propylene resin, vinyl fluoride resin, vinylidene fluoride resin, dichlorodifluoroethylene resin, and copolymers of these polymers. These materials may be used singly or in combination of two or more species. In these materials, tetrafluoroethylene resin and vinylidene fluoride resin may preferably be used.

The fluorine-containing resin particles can appropriately be selected from the above materials having various molecular weights and particle sizes. The fluorine-containing resin particles generally have a weight average molecular weight (Mw) of 3,000–10,000,000 and also have an average particle size of 0.01–2 $\mu$m.

The binder resin used in the protective layer may include various resins such as polycarbonate resin, polyester resin, polyarylate resin, polystyrene resin, polyethylene resin, polypropylene resin, polyurethane resin, acrylic resin, epoxy resin, silicone resin, cellulose resin, vinyl chloride resin, phosphazene resin, melamin resin, and vinyl chloride-vinyl acetate copolymer. These binder resins may be used singly or in combination of two or more species.

In the above binder resins, curable resins (i.e., thermosetting resin or polymers obtained through thermal- or photo-polymerization) may preferably be used in view of properties of the protective layer, such as, surface hardness, resistance to abrasion (or wear), dispersibility of fine particles, and stability of dispersion. More specifically, in a preferred embodiment, electroconductive particles and fluorine-containing resin particles are dispersed in a solution of a curable (or polymerizable) monomer or oligomer capable of being thermal- or photo-cured (or polymerized) in an appropriate solvent to form a coating liquid for a protective layer. The coating liquid is applied onto a photosensitive layer, followed by curing (or polymerization) by heating or light irradiation to form the protective layer. The thus formed protective layer may preferably be used in the present invention in view of dispersibility, hardness, resistance to abrasion, etc.

Generally, thermal- or photo-curable (or polymerizable) monomers or oligomers may, e.g., have at least one functional group as a terminal group causing polymerization reaction by using thermal energy or light energy. In the above, relatively high molecular weight compounds having 2–20 recurring structural units may be referred to as "oligomer" and compounds having relatively low molecular weight smaller than those of such oligomers may be referred to as "monomer".

Examples of the above-mentioned functional group causing polymerization reaction may include: groups having a double bond of C═C, such as acryloyl group, methacryloyl group and vinyl group; silanol group; groups causing ring-opening polymerization, such as cyclic ether group; and two or more species of compounds, such as phenol and formaldehyde, causing polymerization reaction therebetween.

The protective layer may preferably have a resistivity of $10^{10}$–$10^{15}$ ohm.cm. The resistivity of the protective layer varies depending upon electroconductive particles content. In view of the above preferred resistivity of the protective layer, the protective layer may preferably contain 10–80 wt. %, more preferably 20–70 wt. % of the electroconductive particles.

The protective layer may preferably contain 5–70 wt. %, more preferably 10–60 wt. % of the fluorine-containing resin particles. Above 70 wt. %, the protective layer is liable to have a lowered mechanical strength. Below 5 wt. %, the protective layer fails to have sufficient properties such as releasability, resistance to abrasion, and resistance to marring.

The protective layer may preferably have a thickness of 0.2–10 μm, more preferably 0.5–6 μm.

In a preferred embodiment of the present invention, the protective layer may further contain one or two or more compounds including: a coupling agent such as silane coupling agent or titanate-type coupling agent; a surfactant; a silicone oil; and a graft polymer having a water-repellent group. Among the above compounds, compounds containing fluorine atom may particularly be preferred in view of an improvement in a compatibility with the above-mentioned fluorine-containing resin particles.

Preferred examples of such compounds are enumerated below but are not restricted to the following compounds.

Silane Coupling Agent vinyl chlorosilane, vinyl triethoxysilane, vinyl-tris(β-methoxyethoxy)silane, β-(3,4-epoxycyclohexyl)ethyltrimethoxysilane, γ-glycidoxypropyltriethoxysilane, N-β-(amonoethyl)-γ-amonopropylmethyldimethoxy-silane, N,N-bis(β-hydroxyethyl)-γ-aminopropyltriethoxy-silane, γ-chloropropyltrimethoxysilane, and γ-methacryloxypropyltriethoxysilane.

Fluorine-containing Silane Coupling Agent $CF_3CH_2CH_2Si(OCH_3)_3$, $C_4F_9CH_2CH_2Si(OCH_3)_3$, $C_6F_{13}CH_2CH_2Si(OCH_3)_3$, $C_8F_{17}CH_2CH_2Si(OCH_3)_3$, $C_8F_{17}CH_2CH_2Si(OCH_2CH_2OCH_3)_3$, $C_{10}F_{21}Si(OCH_3)_3$, $C_6F_{13}CONHSi(OCH_3)_3$, $C_8F_{17}CONHSi(OCH_3)_3$, $C_7F_{15}CONHCH_2CH_2CH_2Si(OCH_3)_3$, $C_7F_{15}CONHCH_2CH_2CH_2Si(OC_2H_5)_3$, $C_7F_{15}COOCH_2CH_2CH_2Si(OCH_3)_3$, $C_7F_{15}COSCH_2CH_2CH_2Si(OCH_3)_3$, $C_8F_{17}SO_2NHCH_2CH_2CH_2Si(OC_2H_5)_3$, $C_8F_{17}SO_2N(CH_2CH_2CH_3)CH_2CH_2CH_2Si(OCH_3)_3$, $C_8F_{17}CH_2CH_2SCH_2Si(OCH_3)_3$, $C_{10}F_{21}CH_2CH_2SCH_2CH_2Si(OCH_3)_3$, $C_7F_{15}CONHCH_2CH_2N(COC_7F_{15})CH_2CH_2CH_2Si(OCH_3)_3$, and $C_7F_{15}SO_2NHCH_2CH_2N(SO_2C_8F_{17})CH_2CH_2CH_2Si(OCH_3)_3$.

Fluorine-modified Silicone Oil

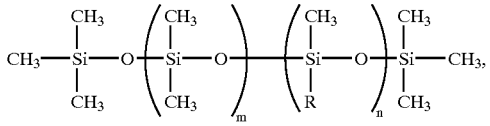

wherein, R denotes $—CH_2CH_2CF_3$, and m and n are a positive integer.

Fluorine-containing Surfactant $X\text{-}SO_2NRCH_2COOH$, $X\text{-}SO_2NRCH_2CH_2O(CH_2CH_2O)_nH$ (n=5, 10, 15), $X\text{-}SO_2N(CH_2CH_2CH_2OH)_2$, $X\text{-}RO(CH_2CH_2O)_n$ (n=5, 10, 15), $X\text{-}(RO)_n$ (n=5–20), $X\text{-}(RO)_nR$ (n=5–20), $X—SO_2NRCH_2CH(\backslash O/)CH_2$, X-COOH, $X\text{-}CH_2CH_2COOH$,

X-ORCOOH, $X\text{-}ORCH_2COOH$, $X\text{-}SO_3H$, $X\text{-}ORSO_3H$, $X\text{-}CH_2CH_2OH$,

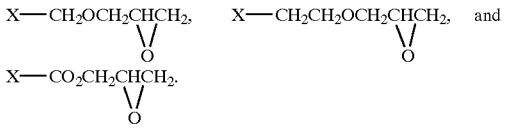

In the above, R denotes alkyl group, aryl group or aralkyl group; and X denotes a fluorocarbon group such as $—CF_3$, $C_4F_9$ or $—C_8F_{17}$.

Fluorine-containing Graft Polymer

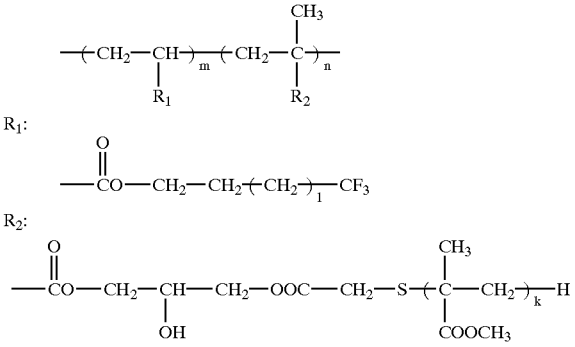

In the above, m, n, l and k each is an integer.

The above compounds (i.e., coupling agent, surfactant, etc.) can be contained in the protective layer by treating the surface of electroconductive particles with at least one compound described above or by simply adding at least one compound described above to a coating liquid for the protective layer. In the present invention, the former (i.e., surface treatment) may preferably be applied.

A method for performing surface treatment of electroconductive particles may be as follows:

Electroconductive particles and a surface treatment agent (i.e., the above-mentioned compounds) are mixed and dispersed in an appropriate solvent by an ordinary dispersion means such as a ball mill or a sand mill, whereby the surface treatment agent is attached or adsorbed to the surface of the electroconductive particles. Then, the solvent is removed from the dispersion to hold or fix the agent to the surface of the electroconductive particles, followed by heat treatment as desired. Further, a catalyst for accelerating the surface treatment may be added to the dispersion. It is possible to effect pulverization or milling after the surface treatment.

A surface treatment agent content of electroconductive particles varies depending upon a particle size of the electroconductive particles. The content may preferably be 1–65 wt. %, more preferably 10–50 wt. % per a total amount of the electroconductive particles.

When the above-mentioned compounds (i.e., coupling agent, surfactant etc.) are used simply by adding, the compounds may preferably be contained in the protective layer in an amount of 1–100 wt. %, particularly 5–50 wt. % per a total amount of the electroconductive particles.

In the present invention, the protective layer may further contain additives, such as radical scavenger and antioxidant, in order to improve dispersibility, binding properties, weathering resistance etc.

The photosensitive layer of the photosensitive member according to the present invention may have a layer structure including: a so-called "single layer-type" structure comprising a single layer containing a charge-generating material (CGM) and a charge-transporting material (CTM); or a so-called "function separation-type" structure comprising a charge generating layer (CGL) containing a CGM and a charge transport layerl (CTL) containing a CTM. The photosensitive layer may preferably have a function separation-type layer structure.

Such a function separation-type layer structure can be formed by disposing a CGL and CTL on an electroconductive support in this order or in reverse order.

The CGL can be formed by dispersing a CGM in a binder together with an appropriate solvent to form a coating liquid, applying the coating liquid onto an electroconductive support or a CTL, and by drying the coating. At this time, examples of such a CGM may include: azo pigments such as monoazo pigment, bisazo pigment and trisazo pigment; quinone pigments such as pyrenequinone and anthraquinone; quinonecyanine pigments; perylene pigments; indigo pigments such as indigo and thioindigo; azulenium salt pigments; and phthalocyanine pigments. The binder may include polyvinyl butyral, polyvinyl benzal, polyarylate, polycarbonate, polyester, polystyrene, polyvinyl acetate, acrylic resin, polyurethane, polyvinyl pyrrolidone, ethyl cellulose, and cellulose acetate butyrate.

The CGL may preferably have a thickness of at most 5 $\mu$m, more preferably 0.05–3 $\mu$m.

The CTL can be formed in the same manner as in the case of the CGL except that a CTM is used instead of the CGM and a coating liquid is applied onto an electroconductive support or the CGL. In this case, examples of such a CTM may include: polycyclic aromatic compounds such as biphenylene, anthracene, pyrene, and phenanthrene; heterocyclic compounds such as indole, carbazole, oxadiazole, and pyrazoline; hydrazone compounds; styryl-type compounds. Further, the binder for the CTM may include: polyester, polycarbonate, acrylic resin, polyarylate, acrylonitrile-styrene copolymer, polymethacrylate, polystyrene, polyvinyl carbazole, and polyvinyl anthracene.

The CTL may preferably have a thickness of 5–40 $\mu$m, more preferably 10–30 $\mu$m.

The single layer-type layer structure of the photosensitive layer may include the above-mentioned materials for the CGM and CTM. It is also possible to contain a charge transfer complex comprising polyvinyl carbazole and trinitrofluorene. The photosensitive layer having a single layer-type layer structure may preferably have a thickness of 5–40 $\mu$m, more preferably 10–30 $\mu$m.

In the present invention, it is possible to dispose an intermediate layer between the photosensitive layer and the protective layer in order to improve adhesive properties, coating properties, etc. Materials for use in the intermediate layer may include: casein, polyvinyl alcohol, nitrocellulose, ethylene-acrylic acid copolymer, alcohol-soluble polyamide, polyurethane, gelatin, and aluminum oxide.

The intermediate layer may preferably have a thickness of 0.1–10 $\mu$m, more preferably 0.3–2 $\mu$m.

The electroconductive support constituting the photosensitive member according to the present invention may include any electroconductive material. More specifically, examples of the electroconductive material may include: metal or alloy, such as aluminum, aluminum alloy, copper, chromium, nickel, zinc, or stainless steel; a laminated plastic film covered with a metal foil of aluminum, copper, etc.; an plastic film covered with aluminum, indium oxide, tin oxide, etc. by vapor deposition; and metal, plastic film or paper each covered with an electroconductive layer formed by applying a coating liquid comprising an electroconductive substance and an optional appropriate binder and/or solvent as desired.

Examples of such an electroconductive substance may include: metal powder, metal foil and metal short fiber each comprising aluminum, copper, nickel or silver; electroconductive metal oxide such as antimony oxide, indium oxide or tin oxide; an electroconductive polymer such as polypyrrole, polyaniline, or polyelectrolyte; a powder material comprising carbon fiber, carbon black, or graphite; organic or inorganic electrolyte; electroconductive powder coated with the above electroconductive substances.

The electroconductive support may preferably be in the form of a cylinder or drum, a sheet, or a belt.

In the present invention, it is possible to dispose an undercoat layer having a barrier function and an adhesive function between the electroconductive support and the photosensitive layer. Materials for the undercoat layer may be those for the intermediate layer described above.

The undercoat layer used in the present invention may be a single layer optionally containing electroconductive materials such as metal, metal oxide and carbon black, in a thickness of 0.1–5 $\mu$m, particularly 0.5–3 $\mu$m. The undercoat layer may also be a laminated layer comprising a first undercoat layer containing the electroconductive materials and a second undercoat layer not containing the electroconductive materials disposed on the electroconductive support in this order. In this instance, the first undercoat layer may preferably have a thickness of 0.1–50 $\mu$m, particularly 0.5–40 $\mu$m.

In the present invention, the above-mentioned various layers may generally be formed by dispersing materials to be used in respective layers in an appropriate solvent, applying the resultant coating liquid onto the electroconductive support by means of a known coating method such as dipping, spinner coating, roller coating, wire bar coating, spray coating or been coating, and drying the coating.

The photosensitive member according to the present invention can be applied to not only an ordinary electrophotographic apparatus such as copying machine, a laser beam printer, a light-emitting diode (LED) printer, a cathode-ray tube (CRT) printer, a liquid crystal shutter-type printer, but also other fields of applied electrophotography including, e.g., display, recording, printing, facsimile and laser plate making.

FIG. 1 shows a schematic structural view of an electrophotographic apparatus using an electrophotographic photosensitive member of the invention. Referring to FIG. 1, a photosensitive drum (i.e., photosensitive member) 1 as an image-carrying member is rotated about an axis la at a prescribed peripheral speed in the direction of the arrow shown inside of the photosensitive drum 1. The surface of the photosensitive drum is uniformly charged by means of a charger 2 to have a prescribed positive or negative potential. At an exposure part 3, the photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member 1 (photosensitive drum), the charger 2, the developing means 4, the cleaner 6, etc. so as to be attached or removed as desired. The device unit may, for example, be composed of the photosensitive member and at least one device of the charger, the developing means and the cleaner to prepare a single unit capable of being attached to or removed from the body of the electrophotographic apparatus by using a guiding means such as a rail in the body.

In cases where the electrophotographic apparatus is used as a copying machine or a printer, exposure light-image L may be effected by using reflection light or transmitted light from an original or by reading a data on the original by a sensor, converting the data into a signal and then effecting a laser beam scanning, drive of LED array or drive of a liquid crystal shutter array in accordance with the signal.

Figure 2:
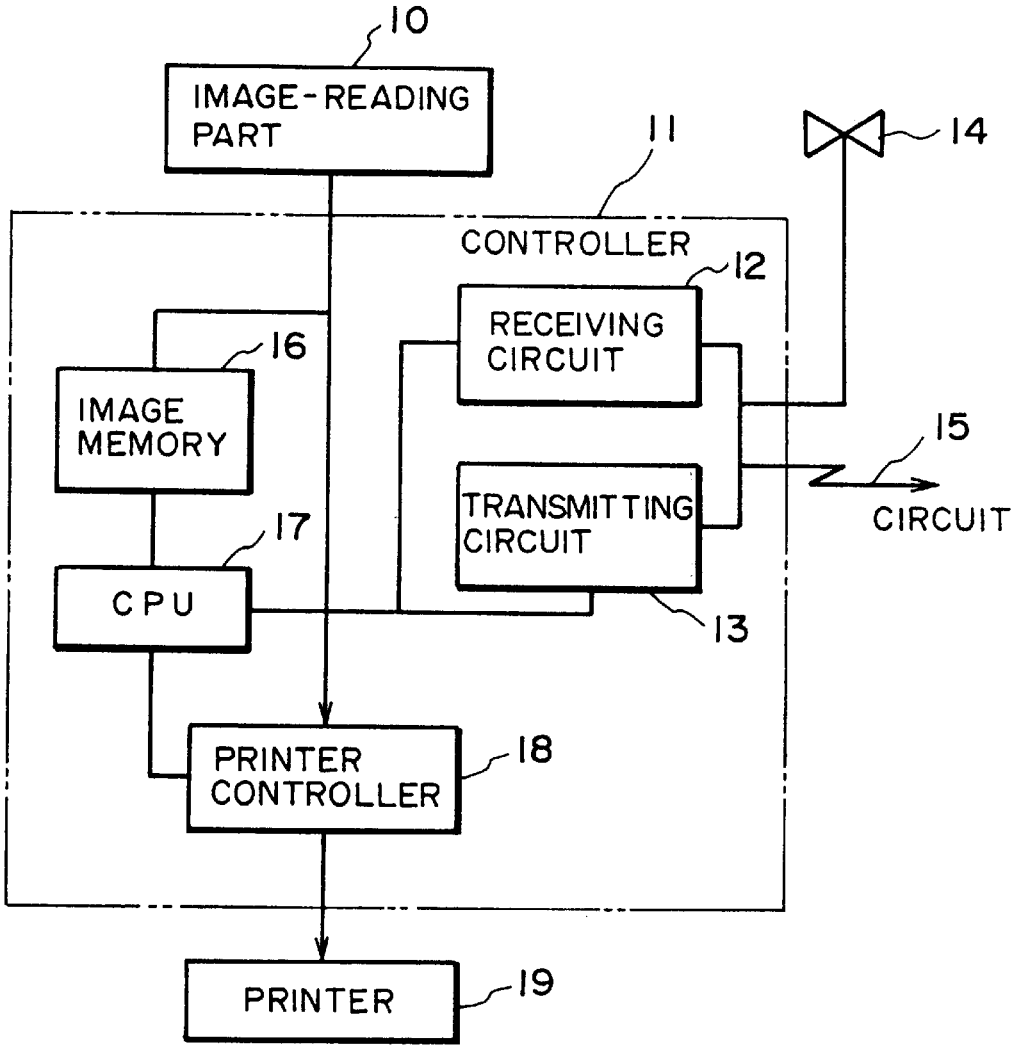
FIG. 2 is a block diagram of a facsimile machine using an electrophotographic apparatus according to the present invention as a printer.

In cases where the electrophotographic apparatus according to the present invention is used as a printer of a facsimile machine, exposure light-image L is given by exposure for printing received data. FIG. 2 shows a block diagram of an embodiment for explaining this case. Referring to FIG. 2, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory 16 memorizes prescribed image data. A printer controller 18 controls the printer 19, and a reference numeral 14 denotes a telephone handset.

The image received through a circuit 15 (the image data sent through the circuit from a connected remote terminal) is demodulated by means of the receiving circuit 12 and successively stored in an image memory 16 after a restoring-signal processing of the image data. When image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive an image for a subsequent page during the recording by the printer 19. As described above, the receiving and recording of the image are performed.

Hereinbelow, the present invention, will be explained more specifically with reference to examples. In the following examples, "part(s)" means "weight part(s)".

EXAMPLE 1

A solution of 10 parts of an alcohol-soluble polyamide resin ("Amilan CM-8000", manufactured by Toray K.K.)

and 30 parts of a methoxymethylated 6-nylon resin ("Toresin EF-30T", mfd. by Teikoku Kagaku K.K.) in a mixture solvent of 150 parts of methanol and 150 parts of butanol was applied onto an aluminum cylinder by dipping, followed by drying for 10 minutes at 90° C. to form a 1 μm-thick undercoat layer.

A coating liquid for a charge generating layer (CGL) was prepared by dispersing a mixture of 4 parts of a bisazo pigment of the formula:

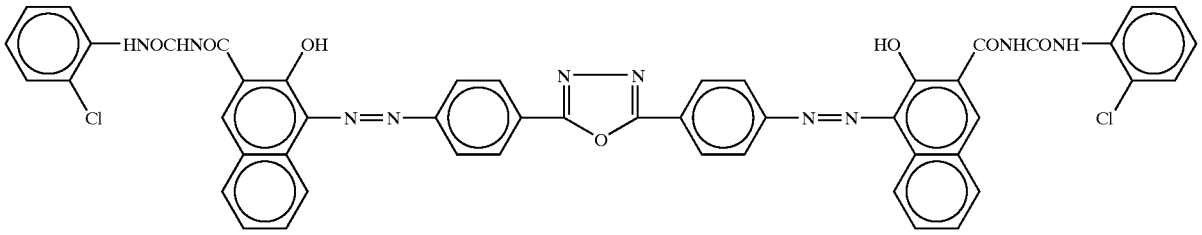

and 2 parts of a butyral resin ("S-LEC BL-S", mfd. by Sekisui Kagaku K.K.) in 100 parts of cyclohexanone by means of a sand mill for 48 hours and by adding 100 parts of tetrahydrofuran (THF) to the above mixture. The thus prepared coating liquid was applied onto the above prepared undercoat layer by dipping, followed by drying for 15 minutes at 80° C. to form a 0.15 μm-thick CGL.

Onto the CGL, a solution of 10 parts of a triarylamine compound of the formula:

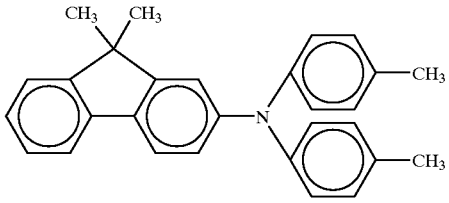

and 10 parts of a polycarbonate resin ("Iupiron Z-200", mfd. by Mitsubishi Gas Kagaku K.K.) in a mixture solvent of 20 parts of dichloromethane and 50 parts of monochlorobenzene was applied by dipping, followed by drying for 60 minutes at 120° C. to form a 20 μm-thick charge transport layer (CTL). Thus, a photosensitive layer was disposed on the electroconductive support.

Then, a dispersion for a protective layer was prepared as follows.

100 parts of antimony-containing tin oxide fine particles ("T-1", mfd. by Mitsubishi Material K.K.; average particle size of 0.02 μm), 30 parts of (3,3,3-trifluoropropyl) trimethoxysilane (mfd. by Shinetsu Kagaku K.K.), and 300 parts of a mixture solvent of ethanol/water (95/5) were subjected to milling for 1 hour by a milling device. After the milling, the mixture was filtered and then the filtrate was washed with ethanol, followed by drying and heat treatment for 1 hour at 120° C. to effect surface treatment of the fine particles. Then, 25 parts of an acrylic polymerizable monomer, to be used as a binder resin, of the formula:

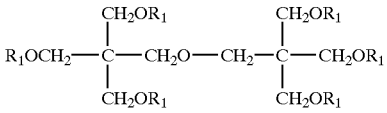

-continued

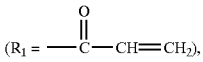

0.1 part of 2-methylthioxanthone as a photopolymerization initiator, 35 parts of the above-prepared surface-treated antimony-containing tin oxide fine particles, and 300 parts of toluene were mixed by a sand mill for 96 hours. To the mixture, 25 pats of tetrafluoroethylene resin particles ("Lublon L-2", mfd. by Daikin Kogyo K.K.) was added, followed by stirring for 8 hours by the sand mill to form a dispersion for a protective layer.

The thus prepared dispersion was applied onto the photosensitive layer by spray coating and dried, followed by ultraviolet ray irradiation for 15 seconds by means of a high-pressure mercury lamp at a light intensity of 800 mW/cm$^2$.

Thus, a 5 μm-thick protective layer was disposed on the photosensitive layer, whereby a photosensitive member of the present invention was prepared.

EXAMPLE 2

A photosensitive member was prepared in the same manner as in Example 1 except that 45 parts of tetrafluoroethylene resin particles and 45 parts of surface-treated antimony-containing tin oxide fine particles were used in the step of forming the dispersion for a protective layer.

EXAMPLE 3

A photosensitive member was prepared in the same manner as in Example 1 except for using an acrylic polymerizable monomer of the formula:

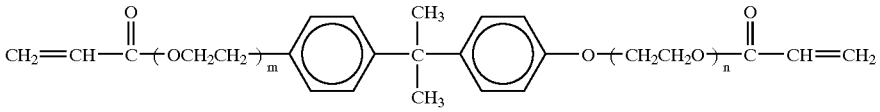

(m + n = 4)

instead of the acrylic polymerizable monomer used in Example 1.

EXAMPLE 4

A photosensitive member was prepared in the same manner as in Example 1 except that a dispersion for a protective layer was prepared in the following manner.

100 parts of antimony-containing tin oxide fine particles ("T-1", mfd. by Mitsubishi Material K.K.; average particle size of 0.02 μm), 30 parts of fluorine-modified silicone oil ("FL-100", mfd. by Shinetsu Kagaku K.K.), and 300 parts of toluene were subjected to milling for 1 hour by a milling device. After the milling, the mixture was filtered and then the filtrate was washed with toluene, followed by drying and heat treatment for 10 minutes at 300° C. to effect surface treatment of the fine particles. Then, 25 parts of an acrylic polymerizable monomer, to be used as a binder resin, of the formula:

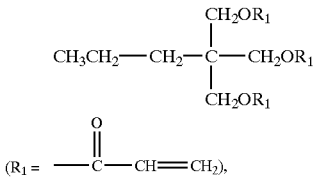

0.1 part of 2-methylthioxanthone as a photopolymerization initiator, 50 parts of the above-prepared surface-treated antimony-containing tin oxide fine particles, and 300 parts of toluene were mixed by a sand mill for 96 hours. To the mixture, 35 parts of tetrafluoroethylene resin particles ("Lublon L-2", mfd. by Daikin Kogyo K.K.) was added, followed by stirring for 4 hours by the sand mill.

EXAMPLE 5

A photosensitive member was prepared in the same manner as in Example 1 except that tetrafluoroethylene resin particles were changed to chlorotrifluoroethylene resin particles ("Diflon", mfd. by Daikin Kogyo K.K.).

EXAMPLE 6

A photosensitive member was prepared in the same manner as in Example 1 except that the antimony-containing tin oxide fine particles were changed to electroconductive particles comprising barium sulfate fine particles coated with oxygen-short tin oxide, i.e., tin oxide containing oxygen less than stoichiometry ("Pastran IV/P-1", mfd. by Mitsui Kinzoku Kogyo K.K.; average particle size of 0.1 μm).

EXAMPLE 7

A photosensitive member was prepared in the same manner as in Example 1 except that a CGL and a CTL were formed in reverse order.

EXAMPLE 8

A photosensitive member was prepared in the same manner as in Example 1 except that an intermediate layer was further disposed between a photosensitive layer and a protective layer in the following manner.

A solution of a silicone resin ("AY42-441", mfd. by Toray Silicone K.K.) in ligroin was applied onto the photosensitive layer by spray coating so as to provide a 0.2 μm-thick (after drying) intermediate layer, followed by drying to obtain the intermediate layer.

EXAMPLE 9

A photosensitive member was prepared in the same manner as in Example 1 except for omitting the surface treatment of the electroconductive particles.

COMPARATIVE EXAMPLE 1

A comparative photosensitive member was prepared in the same manner as in Example 1 except that the protective layer was not used.

COMPARATIVE EXAMPLE 2

A comparative photosensitive member was prepared in the same manner as in Example 1 except that the tetrafluoroethylene resin particles used in the protective layer were not used.

COMPARATIVE EXAMPLE 3

A comparative photosensitive member was prepared in the same manner as in Example 7 except that the protective layer was not used.

Each of the thus prepared photosensitive members was assembled in an electrophotographic copying machine performing an image formation process including the steps of: charging-exposure-development-transfer-cleaning at a cycle speed of 1.5 sec/cycle, and was subjected to image formation at an initial stage under environmental conditions including normal-temperature (20° C.) and normal-humidity (50%RH) condition (hereafter, abbreviated as "N/N"), low-temperature (10° C.) and low-humidity (15%RH) condition (hereinafter, abbreviated as "L/L"), and high-temperature (35° C.) and high-humidity (85%RH) condition (hereinafter, abbreviated as "H/H") in order to evaluate image forming properties. Further, each of the photosensitive members was subjected to successive image formation of 50,000 sheets (a durability test) under N/N. The results are shown in Table 1 appearing hereinafter.

After the image formation of 50,000 sheets, each of the photosensitive members was subjected to observation of an abrasion degree, i.e., a thickness (μm) of a part of the photosensitive member which had been removed therefrom by abrasion. The results are also shown in Table 1.

In the initial stage of the above image formation under N/N, each of the photosensitive members was subjected to measurement of electrophotographic properties including initial dark part potential $V_{DARK}$ (V), sensitivity (lux.sec) and residual potential $V_R$ (V).

In the above, "initial dark part potential" means a surface potential (V) of a photosensitive member at the time of charging by using corona discharger (−5 KV or +5 KV (only for the photosensitive member prepared in Example 7)). A larger absolute value of an initial dark part potential shows a better chargeability in Table 1. Further, "sensitivity" means an exposure quantity ($E_{2/7}$; lux.sec) required for decreasing a surface potential of 700 V (absolute value) to a surface potential of 200 V (absolute value). The results are also shown in Table 1.

Separately, each of the photosensitive members was assembled in a modified copying machine of a copying machine ("NP-3825", mfd. by Canon K.K.) in order to evaluate "pause memory characteristic". More specifically, a photosensitive member was caused to have a dark part potential ($V_{D0}$) of −650 V and a light part potential ($V_{L0}$) of −150 V at an initial stage, respectively. Then, the copying machine was subjected to successive copying test of 10,000 sheets. After the copying test, a dark part potential ($V_{D1}$) and a light part potential ($V_{L1}$) were measured to obtain a variation (%) in the potentials $V_{D0}$ and $V_{D1}$ and a variation (%) in the potentials $V_{L0}$ and $V_{L1}$, respectively. For example, a variation of 2% means a change in potential of 13 V (i.e., 650×2/100). Then, the photosensitive member was left standing for 24 hours within the copying machine. After 24 hours, potentials at a position immediately under the charger and another position (i.e., a position different from the position immediately under the charger) were measured to obtain a difference (ΔV (V), absolute value) therebetween. The results are shown in Table 1.

EXAMPLES 10–17

In order to evaluate "transfer memory", eight photosensitive members for Examples 10–17 were prepared in the same manner as in Examples 1–8, respectively, except that a CGL was prepared in the following manner.

A coating liquid for a CGL was prepared by dispersing a mixture of 4.5 parts of oxytitaniumphthalocyanine and 2 parts of a butyral resin ("S-LEC BL-S", mfd. by Sekisui Kagaku K.K.) in 100 parts of cyclohexanone by means of a sand mill for 36 hours and by adding 100 parts of THF to the above mixture. The thus prepared coating liquid was applied onto an undercoat layer by dipping, followed by drying for 15 minutes at 80° C. to form a 0.15 μm-thick CGL.

EXAMPLE 18

A photosensitive member was prepared and evaluated in the same manner as in Example 10 except for omitting the surface treatment of the electroconductive particles.

EXAMPLE 19

A photosensitive member was prepared and evaluated in the same manner as in Example 15 except for omitting the surface treatment of the electroconductive particles.

COMPARATIVE EXAMPLE 4

A comparative photosensitive member was prepared and evaluated in the same manner as in Example 10 except that the protective layer was not used.

COMPARATIVE EXAMPLE 5

A comparative photosensitive member was prepared in the same manner as in Example 10 except that the tetrafluoroethylene resin particles used in the protective layer were not used.

COMPARATIVE EXAMPLE 6

A comparative photosensitive member was prepared in the same manner as in Example 15 except that the protective layer was not used.

Each of the above-prepared photosensitive members was assembled in a modified machine of a laser beam printer (trade name: LBP-SX, mfd. by Canon K.K.) as an electrophotographic printer equipped with a semiconductor laser and using a reversal development system, and subjected to measurement of a voltage ($V_{d1}$) of a primary charging under no transfer current application and a voltage ($V_{d2}$) of the primary charging under transfer current application to evaluate a transfer memory ($|V_{d1}|-|V_{d2}|$(V); absolute value). The results are shown in Table 2 below.

TABLE 1

| | Electrophotographic properties N/N | | | Durability N/N Initial | Durability N/N After 50,000 sheets | Durability L/L Initial | Durability H/H Initial | Durability Abrasion (μm) | Pause memory Variation | | |
|---|---|---|---|---|---|---|---|---|---|---|---|
| | $V_{DARK}$ (V) | $E_{2/7}$ (lux.sec) | $V_R$ (V) | | | | | | $V_D$ (%) | $V_L$ (%) | $\Delta V_D$ (V) |
| Ex. | | | | | | | | | | | |
| 1 | −1100 | 1.6 | −25 | Good | Good | Good | Good | 0.6 | 1.4 | 0.5 | 10 |
| 2 | −1090 | 1.6 | −30 | Good | Good | Good | Good | 0.8 | 0.8 | 0.2 | 5 |
| 3 | −1110 | 1.7 | −25 | Good | Good | Good | Good | 0.4 | 1.2 | 0.9 | 10 |
| 4 | −1050 | 1.7 | −30 | Good | Good | Good | Good | 0.8 | 1.4 | 1.3 | 15 |
| 5 | −1080 | 1.7 | −30 | Good | Good | Good | Good | 0.7 | 1.5 | 1.0 | 10 |
| 6 | −1100 | 1.6 | −25 | Good | Good | Good | Good | 0.6 | 0.9 | 0.4 | 5 |
| 7 | +1010 | 2.3 | +30 | Good | Good | Good | Good | 0.7 | 1.5 | 1.3 | 15 |
| 8 | −1120 | 1.8 | −30 | Good | Good | Good | Good | 0.6 | 1.8 | 1.9 | 15 |
| 9 | −1030 | 1.7 | −30 | Good | Image flow | Good | Good | 2.0 | 6.1 | 9.1 | 40 |
| Comp. Ex. | | | | | | | | | | | |
| 1 | −1010 | 1.6 | −15 | Good | Poor image density | Good | Good | 6.5 | 21.0 | 18.5 | 110 |
| 2 | −1000 | 1.7 | −25 | Transfer failure | Image flow | Transfer failure | Image blur | 4.8 | 16.7 | 20.1 | 85 |

TABLE 1-continued

| | Electrophotographic properties N/N | | | Durability N/N Initial | Durability N/N After 50,000 sheets | Durability L/L Initial | Durability H/H Initial | Durability Abrasion (μm) | Pause memory Variation $V_D$ (%) | Pause memory Variation $V_L$ (%) | Pause memory Variation $\Delta V_D$ (V) |
|---|---|---|---|---|---|---|---|---|---|---|---|
| | $V_{DARK}$ (V) | $E_{2/7}$ (lux.sec) | $V_R$ (V) | | | | | | | | |
| 3 | +910 | 2.2 | +20 | Transfer failure | — | Transfer failure | Image blur | — | — | — | — |

In the above Table 1, each evaluation results of the durability test denotes the following state.

"Good": Good images substantially free from image defects were obtained.

"Transfer failure": Toner images were not sufficiently transferred to a transfer-receiving material to form mottled or spotted images.

"Image flow": Image flow was observed. "Poor image density": The resultant images had poor image density.

"Image blur": Image blur was observed.

"-": The photosensitive member was not subjected to measurement or observation because the CGL was considerably abraded.

TABLE 2

| Ex. | Transfer memory ($\|V_{d1}\| - \|V_{d2}\|$) (V) |
|---|---|
| 10 | 5 |
| 11 | 0 |
| 12 | 10 |
| 13 | 5 |
| 14 | 5 |
| 15 | 5 |
| 16 | 10 |
| 17 | 5 |
| 18 | 20 |
| 19 | 25 |
| Comp. Ex. 4 | 55 |
| 5 | 45 |
| 6 | 65 |

As shown in Table 1, the photosensitive members prepared in Examples 1–8 according to the present invention provided good electrophotographic properties, image-forming properties under any environmental conditions (i.e., N/N, L/L, H/H). The photosensitive member prepared in Example 9 according to the present invention also provide good electrophotographic properties at the initial stage, but provided slightly poor images at and after about 35,000 sheets of copying due to a decreased chargeability and image flow after 50,000 sheets. However, such properties of the photosensitive member prepared in Example 9 were still acceptable level for practical use.

With respect to the comparative photosensitive members prepared in Comparative Examples 1–3, each evaluation result was as follows.

COMPARATIVE EXAMPLE 1

The comparative photosensitive member showed good electrophotographic properties at the initial stage but failed to provide good images after about 10,000 sheets of copying due to a decreased chargeability.

COMPARATIVE EXAMPLE 2

The comparative photosensitive member failed to provide images over a wide area from the initial stage and provided image blur under H/H. Further, after 50,000 sheets of copying, image flow was observed.

COMPARATIVE EXAMPLE 3

Image blur was caused to occur under H/H and good images were not obtained after about 10,000 sheets of copying due to a remarkable decrease in photosensitivity caused by abrasion of the CGL.

In addition, the comparative photosensitive members prepared in Comparative Examples 1–3 showed considerable poor pause memory characteristic when compared with those prepared in Examples 1–9 according to the present invention.

As shown in Table 2, the photosensitive members prepared in Examples 10–19 according to the present invention provided good transfer memory when compared with those prepared in Comparative Examples 4–6.

EXAMPLE 20

An undercoat layer, a CGL and a CTL were formed on an aluminum cylinder in the order in the same manner as in Example 1 except that the following bisazo pigment of the formula:

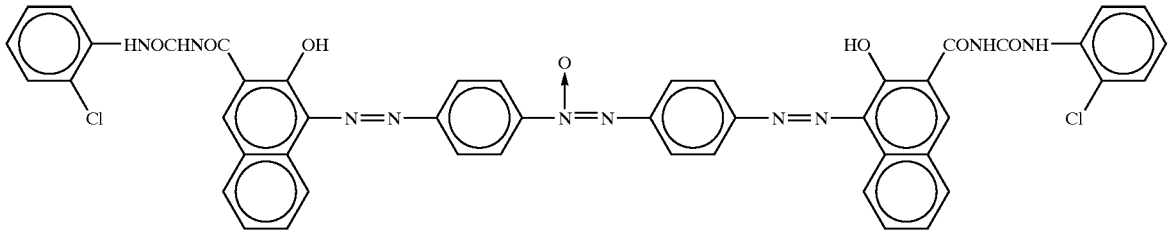

was used instead of the bisazo pigment for use in the CGL prepared in Example 1.

Then, a dispersion for a protective layer was prepared as follows.

25 parts of an acrylic polymerizable monomer, to be used as a binder resin, of the formula:

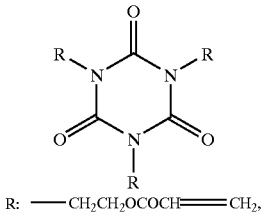

2.0 parts of 2-methylthioxanthone as a photopolymerization initiator, 45 parts of antimony-containing tin oxide fine particles ("T-1", mfd. by Mitsubishi Material K.K.; average particle size of 0.02 $\mu$m), and 300 parts of toluene were mixed by a sand mill for 72 hours. To the mixture, 25 pats of tetrafluoroethylene resin particles ("Lublon L-2", mfd. by Daikin Kogyo K.K.) and 20 parts of fluorine-containing silane coupling agent ($C_4F_9CH_2CH_2Si(OCH_3)_3$) were added, followed by stirring for 4 hours by the sand mill to form a dispersion for a protective layer.

The thus prepared dispersion was applied onto the photosensitive layer by spray coating and dried, followed by ultraviolet ray irradiation for 20 seconds by means of a high-pressure mercury lamp at a light intensity of 800 mW/cm$^2$.

Thus, a 6 $\mu$m-thick protective layer was disposed on the photosensitive layer, whereby a photosensitive member of the present invention was prepared.

EXAMPLE 21

A photosensitive member was prepared in the same manner as in Example 20 except that 45 parts of tetrafluoroethylene resin particles and 35 parts of fluorine-containing silane coupling agent were used in the step of forming a dispersion for a protective layer.

EXAMPLE 22

A photosensitive member was prepared in the same manner as in Example 20 except that an intermediate layer was further disposed between a photosensitive layer and a protective layer in the following manner.

A solution of a silicone resin ("AY42-441", mfd. by Toray Silicone K.K.) in ligroin was applied onto the photosensitive layer by spray coating so as to provide a 0.2 $\mu$m-thick (after drying) intermediate layer, followed by drying to obtain the intermediate layer.

EXAMPLE 23

A photosensitive member was prepared in the same manner as in Example 20 except that a fluorine-containing silane coupling agent ($CF_3CH_2CH_2Si(OCH_3)_3$) was used instead of the one used in Example 20.

EXAMPLE 24

A photosensitive member was prepared in the same manner as in Example 20 except that 20 parts of the fluorine-containing silane coupling agent was changed to 10 parts of a fluorine-containing graft polymer of the formula:

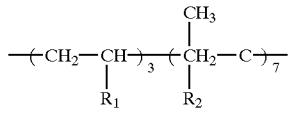

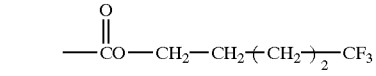

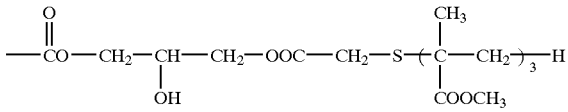

(Weight-average molecular weight (Mw) of 25,000; fluorine content of 22%).

EXAMPLE 25

A photosensitive member was prepared in the same manner as in Example 20 except that a fluorine-modified silicone oil ("FL-100", mfd. by Shinetsu Kagaku K.K.) was used instead of the fluorine-containing silane coupling agent.

EXAMPLE 26

A photosensitive member was prepared in the same manner as in Example 20 except that a fluorine-containing surfactant ($C_4F_9SO_2NCH_3CH_2COOH$) was used instead of the fluorine-containing silane coupling agent.

EXAMPLE 27

A photosensitive member was prepared in the same manner as in Example 20 except that the tetrafluoroethylene resin particles were changed to chlorotrifluoroethylene resin particles ("Diflon", mfd. by Daikin Kogyo K.K.).

EXAMPLE 28

A photosensitive member was prepared in the same manner as in Example 20 except that 20 parts of the fluorine-containing silane coupling agent was changed to 10 parts of a fluorine-containing silane coupling agent ($C_4F_9CH_2CH_2Si(OCH_3)_3$ and 10 parts of a fluorine-containing surfactant ($C_4F_9SO_2NCH_3CH_2COOH$).

EXAMPLE 29

A photosensitive member was prepared in the same manner as in Example 20 except for using an acrylic polymerizable monomer of the formula:

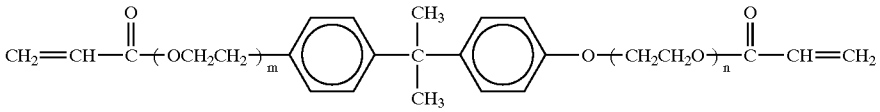

(m + n = 4)

instead of the acrylic polymerizable monomer and a fluorine-containing silane coupling agent ($C_8F_{17}CH_2CH_2SCH_2CH_2Si(OCH_3)_3$) instead of the fluorine-containing silane coupling agent used in Example 20, respectively.

EXAMPLE 30

A photosensitive member was prepared in the same manner as in Example 20 except that a CGL and a CTL were formed in reverse order.

EXAMPLE 31

A photosensitive member was prepared in the same manner as in Example 20 except that the antimony-containing tin oxide fine particles were changed to electroconductive particles comprising barium sulfate fine particles coated with oxygen-short tin oxide, i.e., tin oxide containing oxygen less than stoichiometry ("Pastran IV/P-1", mfd. by Mitsui Kinzoku Kogyo K.K.; average particle size of 0.1 $\mu$m).

EXAMPLE 32

A photosensitive member was prepared in the same manner as in Example 20 except that fluorine-containing silane coupling agent was not used.

COMPARATIVE EXAMPLE 8

A comparative photosensitive member was prepared in the same manner as in Example 20 except that the tetrafluoroethylene resin particles used in the protective layer were not used.

COMPARATIVE EXAMPLE 9

A comparative photosensitive member was prepared in the same manner as in Example 20 except that the tetrafluoroethylene resin particles and the fluorine-containing silane coupling agent used in the protective layer were not used.

COMPARATIVE EXAMPLE 10

A comparative photosensitive member was prepared in the same manner as in Example 30 except that the protective layer was not used.

Each of the thus prepared photosensitive members was evaluated in the same manner as in Example 1. The results are shown in Table 3 appearing hereinafter.

EXAMPLES 33–39

Seven photosensitive members for Examples 33–39 were prepared in the same manner as in Examples 20–26, respectively, except that a CGL was prepared in the same manner as in Example 10.

EXAMPLE 40

A photosensitive member was prepared in the same manner as in Example 33 except that a fluorine-containing silane coupling agent was not used.

EXAMPLE 41

A photosensitive member was prepared in the same manner as in Example 39 except that the fluorine-containing surfactant was not used.

COMPARATIVE EXAMPLE 11

A comparative photosensitive member was prepared and evaluated in the same manner as in Example 33 except that the protective layer was not used.

COMPARATIVE EXAMPLE 12

A comparative photosensitive member was prepared in the same manner as in Example 33 except that the tetrafluoroethylene resin particles used in the protective layer were not used.

COMPARATIVE EXAMPLE 13

A comparative photosensitive member was prepared in the same manner as in Example 33 except that the fluorine-containing silane coupling agent and the tetrafluoroethylene resin particles were not used.

Each of the above prepared photosensitive members were evaluated in the same manner as in Example 10. The results are shown in Table 4 appearing hereinafter.

TABLE 3

| | Electrophotographic properties N/N | | | Durability N/N Initial | After 50,000 sheets | L/L Initial | H/H Initial | Abrasion (μm) | Pause memory Variation $V_D$ (%) | $V_L$ (%) | $\Delta V_D$ (V) |
|---|---|---|---|---|---|---|---|---|---|---|---|
| | $V_{DARK}$ (V) | $E_{2/7}$ (lux.sec) | $V_R$ (V) | | | | | | | | |
| Ex. | | | | | | | | | | | |
| 20 | −1020 | 1.8 | −25 | Good | Good | Good | Good | 0.6 | 2.0 | 0.9 | 12 |
| 21 | −1030 | 1.9 | −30 | Good | Good | Good | Good | 0.3 | 0.6 | 0.5 | 3 |
| 22 | −1020 | 1.9 | −25 | Good | Good | Good | Good | 0.8 | 1.0 | 1.5 | 9 |
| 23 | −1050 | 1.8 | −25 | Good | Good | Good | Good | 0.6 | 0.7 | 2.4 | 15 |
| 24 | −1010 | 1.8 | −30 | Good | Good | Good | Good | 0.6 | 1.4 | 2.0 | 12 |
| 25 | −1030 | 1.9 | −20 | Good | Good | Good | Good | 0.7 | 0.9 | 1.7 | 18 |
| 26 | −1020 | 1.8 | −25 | Good | Good | Good | Good | 0.7 | 1.1 | 1.5 | 10 |
| 27 | −1050 | 1.9 | −25 | Good | Good | Good | Good | 0.7 | 1.3 | 1.8 | 7 |
| 28 | −1040 | 1.8 | −30 | Good | Good | Good | Good | 0.6 | 0.7 | 1.7 | 14 |
| 29 | −1040 | 1.8 | −25 | Good | Good | Good | Good | 0.8 | 0.5 | 2.1 | 15 |
| 30 | +1050 | 2.3 | +30 | Good | Good | Good | Good | 0.8 | 0.8 | 2.2 | 12 |
| 31 | −1030 | 1.9 | −30 | Good | Good | Good | Good | 0.8 | 1.7 | 1.8 | 10 |
| 32 | −1030 | 2.2 | −30 | Good | Image flow | Good | Good | 2.1 | 6.8 | 10.5 | 45 |
| Comp. Ex. | | | | | | | | | | | |
| 7 | −1020 | 1.8 | −15 | Good | Poor image density | Good | Good | 6.2 | 18.0 | 19.5 | 105 |
| 8 | −1120 | 2.1 | −25 | Transfer failure | Image flow | Transfer failure | Image blur | 4.0 | 16.8 | 20.5 | 95 |
| 9 | −1040 | 2.0 | −35 | Transfer failure | Image flow | Transfer failure | Image blur | 5.2 | 23.8 | 24.5 | 125 |
| 10 | +920 | 2.3 | +20 | Good | — | Good | Image blur | — | — | — | — |

In the above Table 3, each evaluation results of the durability test denotes the following state.

"Good": Good images substantially free from image defects were obtained.

"Transfer failure": Toner images were not sufficiently transferred to a transfer-receiving material to form mottled or spotted images.

"Image flow": Image flow was observed.

"Poor image density": The resultant images had poor image density.

"Image blur": Image blur was observed.

"-": The photosensitive member was not subjected to measurement or observation because the CGL was considerably abraded.

TABLE 4

| Ex. | Transfer memory ($\lvert V_{d1}\rvert - \lvert V_{d2}\rvert$) (V) |
|---|---|
| 33 | 5 |
| 34 | 5 |
| 35 | 10 |
| 36 | 5 |
| 37 | 5 |
| 38 | 10 |
| 39 | 5 |
| 40 | 20 |
| 41 | 25 |
| Comp. Ex. 11 | 50 |
| 12 | 45 |
| 13 | 70 |

As shown in Table 3, the photosensitive members prepared in Examples 20–31 according to the present invention provided good electrophotographic properties, image-forming properties under any environmental conditions (i.e., N/N, L/L, H/H). The photosensitive member prepared in Example 32 according to the present invention also provide good electrophotographic properties at the initial stage, but provided image flow after 50,000 sheets of copying. However, such properties of the photosensitive member prepared in Example 32 were still acceptable level for practical use.

With respect to the comparative photosensitive members prepared in Comparative Examples 7–10, each evaluation result was as follows.

COMPARATIVE EXAMPLE 7

The comparative photosensitive member showed good electrophotographic properties at the initial stage but failed to provide good images after about 10,000 sheets of copying due to a decreased chargeability.

COMPARATIVE EXAMPLES 8 AND 9

The comparative photosensitive members failed to provide images over a wide area from the initial stage and provided image blur under H/H. Further, after 50,000 sheets of copying, image flow was observed.

COMPARATIVE EXAMPLE 10

Image blur was caused to occur under H/H and good images were not obtained after about 10,000 sheets of copying due to a remarkable decrease in photosensitivity caused by abrasion of the CGL.

In addition, the comparative photosensitive members prepared in Comparative Examples 7–10 showed considerable poor pause memory characteristic when compared with those prepared in Examples 20–32 according to the present invention.

As shown in Table 4, the photosensitive members prepared in Examples 33–39 according to the present invention provided good transfer memory when compared with those prepared in Comparative Examples 11–13.

EXAMPLE 42

An undercoat layer, a CGL and a CTL were formed on an aluminum cylinder in the order in the same manner as in Example 1 except that the following bisazo pigment of the formula:

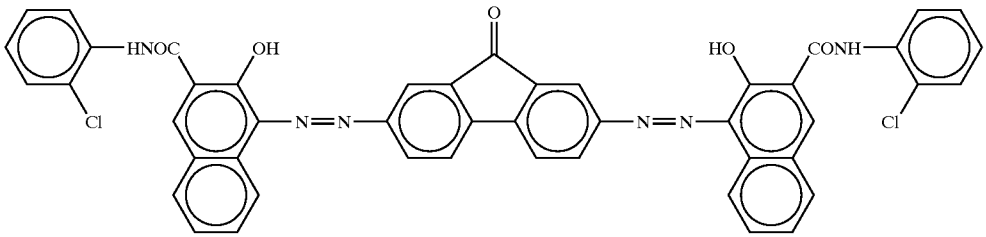

was used instead of the bisazo pigment for use in the CGL and the following triarylamine compound of the formula:

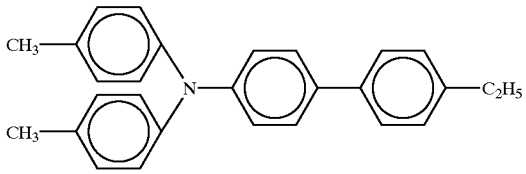

was used instead of the one for use in the CTL prepared in Example 1, respectively.

Then, a dispersion for a protective layer was prepared as follows.

25 parts of an acrylic polymerizable monomer, to be used as a binder resin, of the formula:

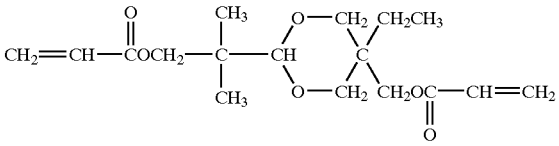

0.1 parts of 2-methylthioxanthone as a photopolymerization initiator, 50 parts of antimony-containing tin oxide fine particles ("T-1", mfd. by Mitsubishi Material K.K.; average particle size of 0.02 μm), and 300 parts of toluene were mixed by a sand mill for 96 hours. To the mixture, 35 parts of tetrafluoroethylene resin particles ("Lublon L-2", mfd. by Daikin Kogyo K.K.) and was added, followed by stirring for 4 hours by the sand mill to form a dispersion for a protective layer.

The thus prepared dispersion was applied onto the photosensitive layer by spray coating and dried, followed by ultraviolet ray irradiation for 10 seconds by means of a high-pressure mercury lamp at a light intensity of 800 mW/cm$^2$.

Thus, a 4 μm-thick protective layer was disposed on the photosensitive layer, whereby a photosensitive member of the present invention was prepared.

EXAMPLE 43

A photosensitive member was prepared in the same manner as in Example 20 except that the acrylic polymerizable monomer was changed to an acrylic polymerizable monomer of the formula:

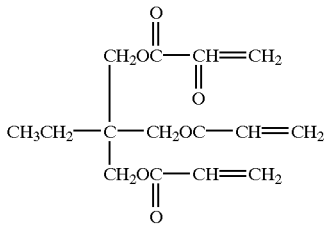

EXAMPLE 44

A photosensitive member was prepared in the same manner as in Example 43 except that the surface treatment of the fine particles was performed in the following manner.

100 parts of antimony-containing tin oxide fine particles ("T-1", mfd. by Mitsubishi Material K.K.; average particle size of 0.02 μm), 10 parts of T-methacryloxypropyltrimethoxysilane ("KBM-503", mfd. by Shinetsu Kagaku K.K.), 1 part of acetic acid, and 1000 parts of water were subjected to milling for 60 hours by a milling device. After the milling, the mixture was filtered and then the filtrate was dried for 5 hours at 120° C. to effect surface treatment of the fine particles.

EXAMPLE 45

A photosensitive member was prepared in the same manner as in Example 43 except for further adding 2.5 parts of γ-methacryloxypropyltrimethoxysilane ("KBM-503", mfd. by Shinetsu Kagaku Kogyo K.K.) to a dispersion for a protective layer.

EXAMPLE 46

A photosensitive member was prepared in the same manner as in Example 43 except that the tetrafluoroethylene resin particles were changed to chlorotrifluoroethylene resin particles ("Diflon", mfd. by Daikin Kogyo K.K.).

EXAMPLE 47

A photosensitive member was prepared in the same manner as in Example 42 except that a CGL and a CTL were formed in reverse order.

EXAMPLE 48

An undercoat layer and a CGL were formed on an aluminum cylinder in the same manner as in Example 10.

Onto the CGL, a solution of 10 parts of a triarylamine compound of the formula:

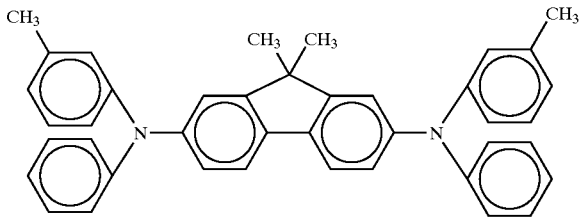

and 10 parts of a polycarbonate resin ("Iupiron Z-200", mfd. by Mitsubishi Gas Kagaku K.K.) in a mixture solvent of 20 parts of dichloromethane and 60 parts of monochlorobenzene was applied by dipping, followed by drying for 60 minutes at 120° C. to form a 15 μm-thick CTL. Thus, a photosensitive layer was disposed on the electroconductive support.

Then, a dispersion for a protective layer was prepared as follows.

30 parts of a heat-curable acrylic resin ("DIANAL HR-620", mfd. by Mitsubishi Rayon K.K.) as a binder resin, 50 parts of antimony-containing tin oxide fine particles ("T-1", mfd. by Mitsubishi Material K.K.; average particle size of 0.02 μm), 150 parts methylethylketone, and 150 parts of ethyl cellosolve acetate were subjected to milling for 48 hours by a milling device. To the mixture, 30 pats of tetrafluoroethylene resin particles ("Lublon L-2", mfd. by Daikin Kogyo K.K.) was added, followed by stirring for 10 hours by the sand mill to form a dispersion for a protective layer.

The thus prepared dispersion was applied onto the photosensitive layer by spray coating and dried for 4 hours at 140° C.

Thus, a 6 μm-thick protective layer was disposed on the photosensitive layer, whereby a photosensitive member of the present invention was prepared.

COMPARATIVE EXAMPLE 14

A comparative photosensitive member was prepared in the same manner as in Example 43 except that the protective layer was not used.

COMPARATIVE EXAMPLE 15

A comparative photosensitive member was prepared in the same manner as in Example 43 except that the tetrafluoroethylene resin particles used in the protective layer were not used.

COMPARATIVE EXAMPLE 16

A comparative photosensitive member was prepared in the same manner as in Example 48 except that the tetrafluoroethylene resin particles used in the protective layer were not used.

COMPARATIVE EXAMPLE 17

A comparative photosensitive member was prepared in the same manner as in Example 47 except that the protective layer was not used.

COMPARATIVE EXAMPLE 18

A comparative photosensitive member was prepared in the same manner as in Example 42 except that the antimony-containing tin oxide fine particles used in the protective layer were not used.

Each of the thus prepared photosensitive members was evaluated in the same manner as in Example 1 except that 50,000 sheets of copying was changed to 30,000 sheets of copying. The results are shown in Table 5 appearing hereinafter.

EXAMPLES 49–54

Six photosensitive members for Examples 49–54 were prepared in the same manner as in Example 42–47, respectively, except that a CGL was prepared in the same manner as in Example 42.

COMPARATIVE EXAMPLE 19

A comparative photosensitive member was prepared in the same manner as in Example 49 except that the protective layer was not used.

COMPARATIVE EXAMPLE 20

A comparative photosensitive member was prepared in the same manner as in Example 49 except that the tetrafluoroethylene resin particles used in the protective layer were not used.

COMPARATIVE EXAMPLE 21

A comparative photosensitive member was prepared in the same manner as in Example 50 except that the tetrafluoroethylene resin particles used in the protective layer were not used.

COMPARATIVE EXAMPLE 22

A comparative photosensitive member was prepared in the same manner as in Example 54 except that the protective layer was not used.

Each of the above prepared photosensitive members were evaluated in the same manner as in Example 10. The results are shown in Table 6 appearing hereinafter.

TABLE 5

| | Electrophotographic properties N/N | | | Durability N/N Initial | After 30,000 sheets | L/L Initial | H/H Initial | Abrasion (μm) | Pause memory Variation | | |
|---|---|---|---|---|---|---|---|---|---|---|---|
| | $V_{DARK}$ (V) | $E_{2/7}$ (lux.sec) | $V_R$ (V) | | | | | | $V_D$ (%) | $V_L$ (%) | $\Delta V_D$ (V) |
| Ex. | | | | | | | | | | | |
| 42 | −1050 | 1.9 | −30 | Good | Good | Good | Good | 1.6 | 5.4 | 9.5 | 40 |
| 43 | −1090 | 1.9 | −30 | Good | Good | Good | Good | 1.8 | 5.8 | 8.2 | 45 |
| 44 | −1110 | 1.7 | −25 | Good | Good | Good | Good | 1.3 | 4.2 | 4.9 | 25 |
| 45 | −1050 | 1.8 | −25 | Good | Good | Good | Good | 1.2 | 4.4 | 5.3 | 25 |
| 46 | −1080 | 1.9 | −30 | Good | Good | Good | Good | 1.7 | 6.5 | 9.0 | 40 |
| 47 | +1100 | 2.4 | +35 | Good | Good | Good | Good | 1.6 | 7.9 | 10.4 | 45 |
| 48 | −1090 | 1.9 | −30 | Good | Good | Good | Good | 1.7 | 6.5 | 9.3 | 40 |
| Comp. Ex. | | | | | | | | | | | |
| 14 | −1010 | 1.7 | −20 | Good | Poor image density | Good | Good | 5.0 | 22.0 | 19.5 | 115 |
| 15 | −1000 | 1.8 | −25 | Transfer failure | Image flow | Transfer failure | Image blur | 3.8 | 16.1 | 22.1 | 85 |
| 16 | −1030 | 1.7 | −25 | Transfer failure | Image flow | Transfer failure | Image blur | 4.5 | 16.8 | 20.1 | 75 |
| 17 | +940 | 2.2 | +20 | Good | — | Good | Image blur | — | — | — | — |
| 18 | −1150 | — | +360 | — | — | — | — | — | — | — | — |

In the above Table 5, each evaluation results of the durability test denotes the following state.

"Good": Good images substantially free from image defects were obtained.

"Transfer failure": Toner images were not sufficiently transferred to a transfer-receiving material to form mottled or spotted images.

"Image flow": Image flow was observed.

"Poor image density": The resultant images had poor image density.

"Image blur": Image blur was observed.

"-": The photosensitive member was not subjected to measurement or observation because the CGL was considerably abraded or the residual potential was too large.

TABLE 6

| Ex. | Transfer memory ($\|V_{d1}\| - \|V_{d2}\|$) (V) |
|---|---|
| 49 | 25 |
| 50 | 25 |
| 51 | 20 |
| 52 | 20 |
| 53 | 25 |
| 54 | 25 |
| Comp. Ex. 19 | 60 |
| 20 | 50 |
| 21 | 45 |
| 22 | 65 |

As shown in Table 5, the photosensitive members prepared in Examples 42–48 according to the present invention provided good electrophotographic properties, image-forming properties under any environmental conditions (i.e., N/N, L/L, H/H).

With respect to the comparative photosensitive members prepared in Comparative Examples 14–18, each evaluation result was as follows.

COMPARATIVE EXAMPLE 14

The comparative photosensitive member showed good electrophotographic properties at the initial stage but failed to provided good images after about 10,000 sheets of copying due to a decreased chargeability.

COMPARATIVE EXAMPLES 15 AND 16

The comparative photosensitive members failed to provide images over a wide area from the initial stage and provided image blur under H/H. Further, after 50,000 sheets of copying, image flow was observed.

COMPARATIVE EXAMPLE 17

Image blur was caused to occur under H/H and good images were not obtained after about 8,000 sheets of copying due to a remarkable decrease in photosensitivity caused by abrasion of the CGL.

COMPARATIVE EXAMPLE 18

The comparative photosensitive member showed a considerable high residual potential and accordingly did not deserve evaluation of image forming properties, an abration degree, and pause memory characxteristics.

As described hereinabove, according to the present invention, there is provided a photosensitive member having good elctrophotographic properties substantially free from a decrease in photosensitivity and an increase in residual potential.

The photosensitive member stably provides high quality images even when used repetitively because the photosensitive member has a protective layer excellent in a surface releasability, a resistance to abrasion and an environmental stability.

The photosensitive member also provides improvements in pause memory characteristics and a transfer memory.

In addition, the comparative photosensitive members prepared in Comparative Examples 14–18 showed considerable poor pause memory characteristic when compared with those prepared in Examples 42–48 according to the present invention.

As shown in Table 6, the photosensitive members prepared in Examples 49–54 according to the present invention provided good transfer memory when compared with those prepared in Comparative Examples 19–22.

What is claimed is:

1. An electrophotographic photosensitive member comprising:

a cylindrical electroconductive support;

a photosensitive layer disposed on the circumference of the cylindrical electroconductive support and a protective layer covering the circumference of the photosensitive layer, wherein said protective layer comprises electroconductive particles, fluorine-containing resin particles, a binder resin and a silane coupling agent as a surface treatment compound.

2. A photosensitive member according to claim 1, wherein said electroconductive particles comprise metal oxide.

3. A photosensitive member according to claim 1, wherein said electroconductive particles have an average particle size of at most 0.3 $\mu$m.

4. A photosensitive member according to claim 3, wherein said electroconductive particles have an average particle size of at most 0.1 $\mu$m.

5. A photosensitive member according to claim 1, wherein said fluorine-containing resin particles comprise tetrafluoroethylene resin or vinylidene fluoride resin.

6. A photosensitive member according to claim 1, wherein said binder resin comprises a curable resin.

7. A photosensitive member according to claim 1, wherein said photosensitive layer comprises a charge generation layer and a charge transport layer.

8. A photosensitive member according to claim 1, further comprising an intermediate layer disposed between said electroconductive support and said photosensitive layer.

9. A photosensitive member according to claim 1, wherein said silane coupling agent contains fluorine and said electroconductive particles have been surface-treated with said surface treatment compound.

* * * * *

UNITED STATES PATENT AND TRADEMARK OFFICE

CERTIFICATE OF CORRECTION

PATENT NO. : 6,664,014 B1 
DATED : December 16, 2003
INVENTOR(S) : Toshihiro Kikuchi et al.

It is certified that error appears in the above-identified patent and that said Letters Patent is hereby corrected as shown below:

Title page, Item [54] and Column 1, line 2,
Title, "MEMBER" should read -- MEMBER, --.

Column 26,
Line 44, "T-methacryloxypropyl-" should read -- γ-methacryloxypropyl- --.

Signed and Sealed this

Twentieth Day of July, 2004

JON W. DUDAS
*Acting Director of the United States Patent and Trademark Office*